US006749292B2

(12) United States Patent
Sturgeon et al.

(10) Patent No.: US 6,749,292 B2
(45) Date of Patent: Jun. 15, 2004

(54) REPLACEABLE INK CONTAINER FOR AN INKJET PRINTING SYSTEM

(75) Inventors: Scott D. Sturgeon, Vancouver, WA (US); Curt G. Gonzales, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 93 days.

(21) Appl. No.: 10/035,588

(22) Filed: Oct. 18, 2001

(65) Prior Publication Data

US 2003/0076390 A1 Apr. 24, 2003

(51) Int. Cl.[7] ..... B41J 2/175; B41J 2/14
(52) U.S. Cl. ..... 347/86; 347/45
(58) Field of Search ..... 347/49, 84, 85, 347/86, 87; 400/724.1

(56) References Cited

U.S. PATENT DOCUMENTS 5,182,581 A 1/1993 Kashimura et al. ..... 347/87
5,619,237 A 4/1997 Inoue et al. ..... 347/86
5,619,239 A 4/1997 Kotaki et al. ..... 347/86
5,622,439 A * 4/1997 Suzuki et al. ..... 400/124.1
5,784,088 A 7/1998 Ujita et al. ..... 347/86
5,788,388 A 8/1998 Cowger et al. ..... 400/703
5,812,156 A 9/1998 Bullock et al. ..... 347/19
5,815,183 A * 9/1998 Sasaki ..... 347/86
5,835,817 A 11/1998 Bullock et al. ..... 399/25
5,847,731 A 12/1998 Kashimura et al. ..... 347/49
6,102,533 A 8/2000 Nozawa et al. ..... 347/86
6,196,670 B1 3/2001 Saruta ..... 347/86
6,390,601 B1 * 5/2002 Morita et al. ..... 347/49

* cited by examiner

*Primary Examiner*—Anh T.N. Vo

(57) ABSTRACT

The present disclosure relates to an ink container to be received within a receiving station of an inkjet printing system. The receiving station has a fluid inlet having a compliant seal and a pair of guide slots extending along either side of the fluid inlet. The ink container includes a guide feature outwardly extending therefrom. The guide feature is disposed toward a trailing end relative to an insertion direction. The guide feature is configured to cooperate with the at least one guide slot to guide the ink container in a pivot motion to ensure the ink container engages the compliant seal forming a seal therewith.

18 Claims, 9 Drawing Sheets

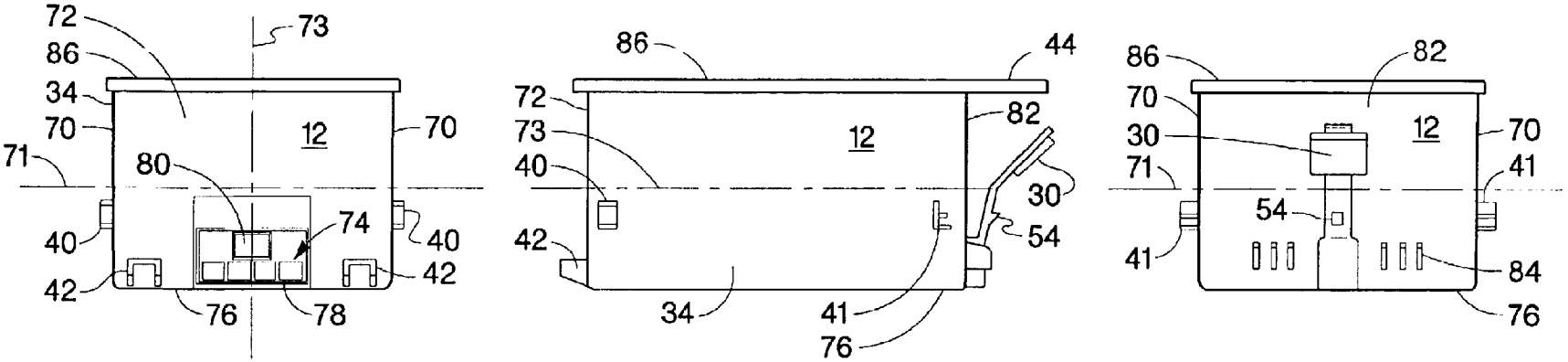
Fig. 5c
Fig. 5b
Fig. 5a
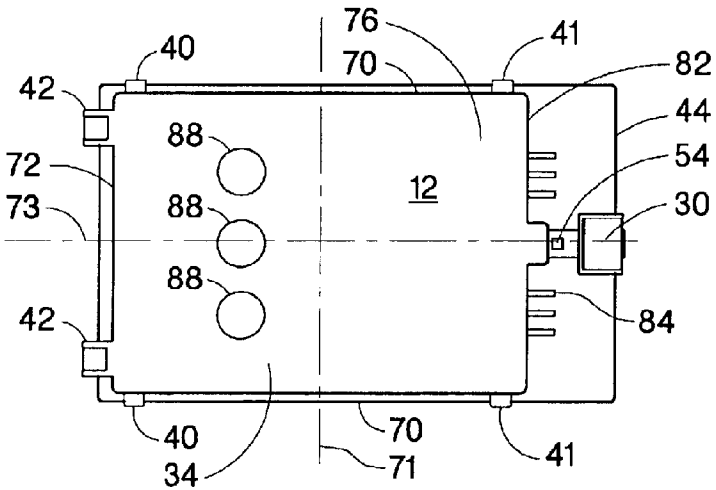
Fig. 5d

REPLACEABLE INK CONTAINER FOR AN INKJET PRINTING SYSTEM

BACKGROUND OF THE INVENTION

The present invention relates to ink containers for providing ink to inkjet printers. More specifically, the present invention relates to a method and apparatus for inserting and removing ink containers from a receiving station within an inkjet printer.

Inkjet printers frequently make use of an inkjet printhead mounted within a carriage that is moved relative to a print media, such as paper. As the printhead is moved relative to the print media, a control system activates the printhead to deposit or eject ink droplets onto the print media to form images and text. Ink is provided to the printhead by a supply of ink that is either integral with the printhead, as in the case of a disposable print cartridge, or by a supply of ink that is replaceable separate from the printhead.

One type of previously used printing system makes use of the ink supply that is carried with the carriage. This ink supply has been formed integral with the printhead, whereupon the entire printhead and ink supply are replaced when ink is exhausted. Alternatively, the ink supply can be carried with the carriage and be separately replaceable from the printhead. For the case where the ink supply is separately replaceable, the ink supply is replaced when exhausted. The printhead is then replaced at the end of printhead life. Regardless of where the ink supply is located within the printing system, it is critical that the ink supply provides a reliable supply of ink to the inkjet printhead.

There is an ever present need for inkjet printing systems that make use of replaceable ink containers that are easy to install and remove. The installation of the ink container should produce reliable fluidic connection to the printer. These ink containers should be relatively easy to manufacture, thereby tending to reduce the ink supply cost. Reduction of the ink supply cost tends to reduce the per page printing costs of the printing system. In addition, these ink containers should be compact and configured to be inserted into the inkjet printing system to maintain a relatively small overall height of the printing system allowing a low profile printing system.

SUMMARY OF THE INVENTION

One aspect of the present disclosure relates to an ink container to be received within a receiving station of an inkjet printing system. The receiving station has a fluid inlet having a compliant seal and a pair of guide slots extending along either side of the fluid inlet. The ink container includes a guide feature outwardly extending therefrom. The guide feature is disposed toward a trailing end relative to an insertion direction. The guide feature is configured to cooperate with the at least one guide slot to guide the ink container in a pivot motion to ensure the ink container engages the compliant seal forming a seal therewith.

Another aspect of the present disclosure is an ink container for insertion into an inkjet printing system. The ink container includes an ink container housing defining a leading end and a trailing end relative to an insertion direction and a pair of sidewalls each extending between the leading and trailing ends. Included is a first pair of guide features, each of the first pair extending outwardly from each of the pair of sidewalls. Also included is a second pair of guide features, each of the second pair extending outwardly from each of the pair of sidewalls.

BRIEF DESCRIPTION OF THE DRAWINGS

FIGS. 5*a*, 5*b*, 5*c*, and 5*d* are isometric views of a three-color replaceable ink container of the exemplary embodiment shown in isolation.

DETAILED DESCRIPTION OF THE EXEMPLARY EMBODIMENT

Figure 1:
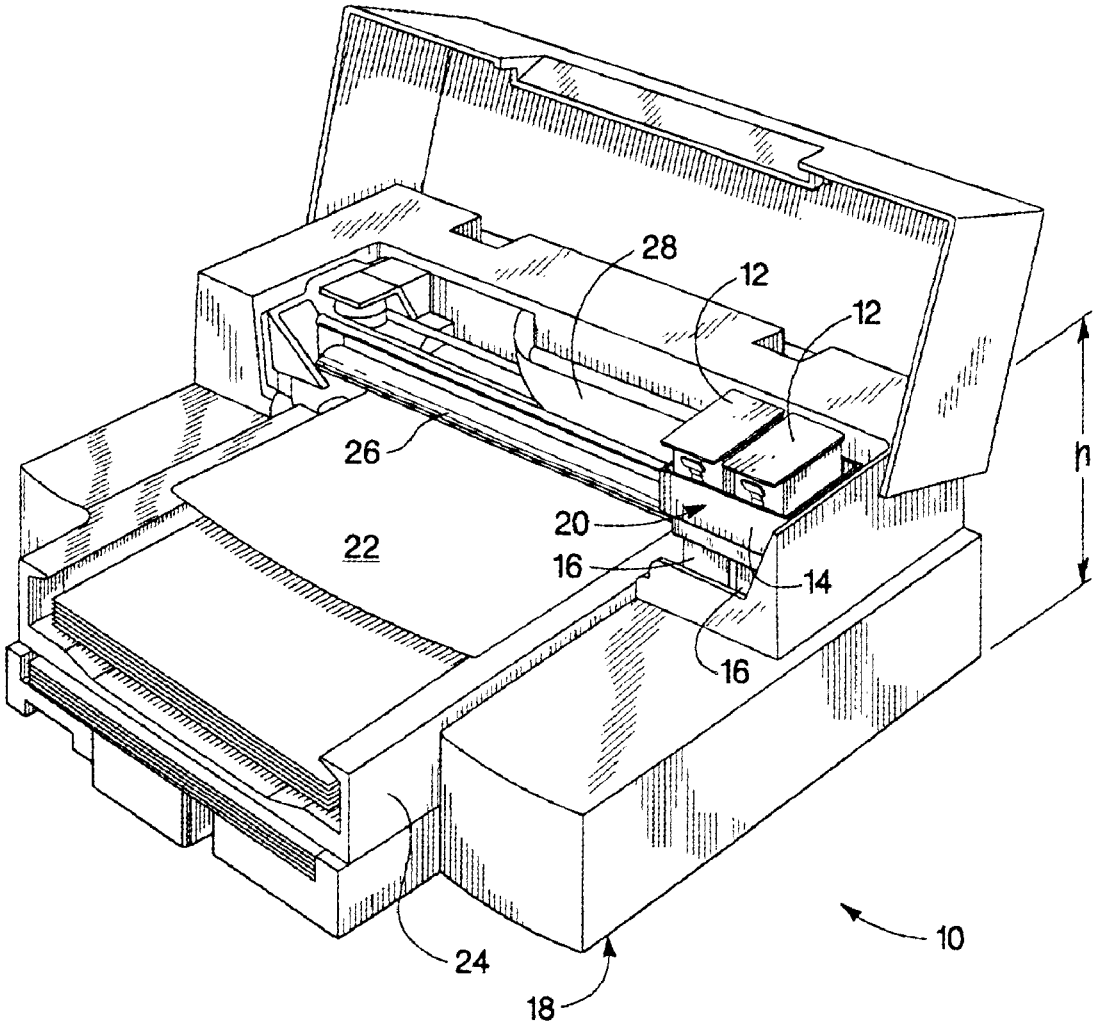
FIG. 1 is one exemplary embodiment of an ink jet printing system shown with a cover opened to show a plurality of exemplary replaceable ink containers.

FIG. 1 is a perspective view of one exemplary embodiment of a printing system 10 shown with its cover open, which includes at least one replaceable ink container 12 that is installed in a receiving station 14. With the replaceable ink container 12 properly installed into the receiving station 14, ink is provided from the replaceable ink container 12 to at least one inkjet printhead 16. The inkjet printhead 16 is responsive to activation signals from a printer portion 18 to deposit ink on print media 22. As ink is ejected from the printhead 16, the printhead 16 is replenished with ink from the ink container 12. In one exemplary embodiment the replaceable ink container 12, receiving station 14, and inkjet printhead 16 are each part of a scanning carriage that is moved relative to a print media 22 to accomplish printing. The printer portion 18 includes a media tray 24 for receiving the print media 22. As the print media 22 is stepped through a print zone, the scanning carriage 20 moves the printhead 16 relative to the print media 22. The printer portion 18 selectively activates the printhead 16 to deposit ink on print media 22 to thereby accomplish printing.

The scanning carriage 20 is moved through the print zone by a scanning mechanism that includes a slide rod 26 on which the scanning carriage 20 slides as the scanning carriage 20 moves along a scan axis. A positioning means (not shown) is used for precisely positioning the scanning carriage 20. In addition, a paper advance mechanism (not shown) is used to step the print media 22 through the print zone as the scanning carriage 20 is moved along the scan axis. Electrical signals are provided to the scanning carriage 20 for selectively activating the printhead 16 by means of an electrical link such as a ribbon cable 28.

One aspect of the exemplary embodiment is a method and apparatus for inserting the ink container 12 into the receiving station 14 such that the ink container 12 forms proper fluidic and electrical interconnect with the printer portion 18. Upon insertion, fluidic connection is established between the ink container 12 and the printer portion 18. The fluidic interconnection allows a supply of ink within the replaceable ink container 12 to be fluidically coupled to the printhead 16 for providing a source of ink to the printhead 16.

The electrical interconnection between the ink container 12 and the printer portion 18 may also be established to allow information to be passed between the replaceable ink container 12 and the printer portion 18. Information passed between the replaceable ink container 12 and the printer portion 18 includes, for example, information related to the compatibility of replaceable ink container with printer portion 18 and operation status information such as ink level information.

The exemplary method and apparatus of the present disclosure, as will be discussed with respect to FIGS. 2 through 9, depicts those features that allow the replaceable ink container 12 to be inserted into the receiving station 14 in such a manner that reliable fluidic connection is established between the replaceable ink container 12 and the receiving station 14. In addition, the method and apparatus of the present invention allows for the insertion and removal of the replaceable printing component 12 from the printer portion 18 in a reliable fashion while allowing the overall height of the printer portion 18, represented by dimension designated as "h" in FIG. 1 to be a relatively small dimension, thereby providing a relatively low profile printing system 10. A low profile allows for a more compact printing system as well as allows the printer portion 18 to be used in a variety of printing applications.

Figure 2:
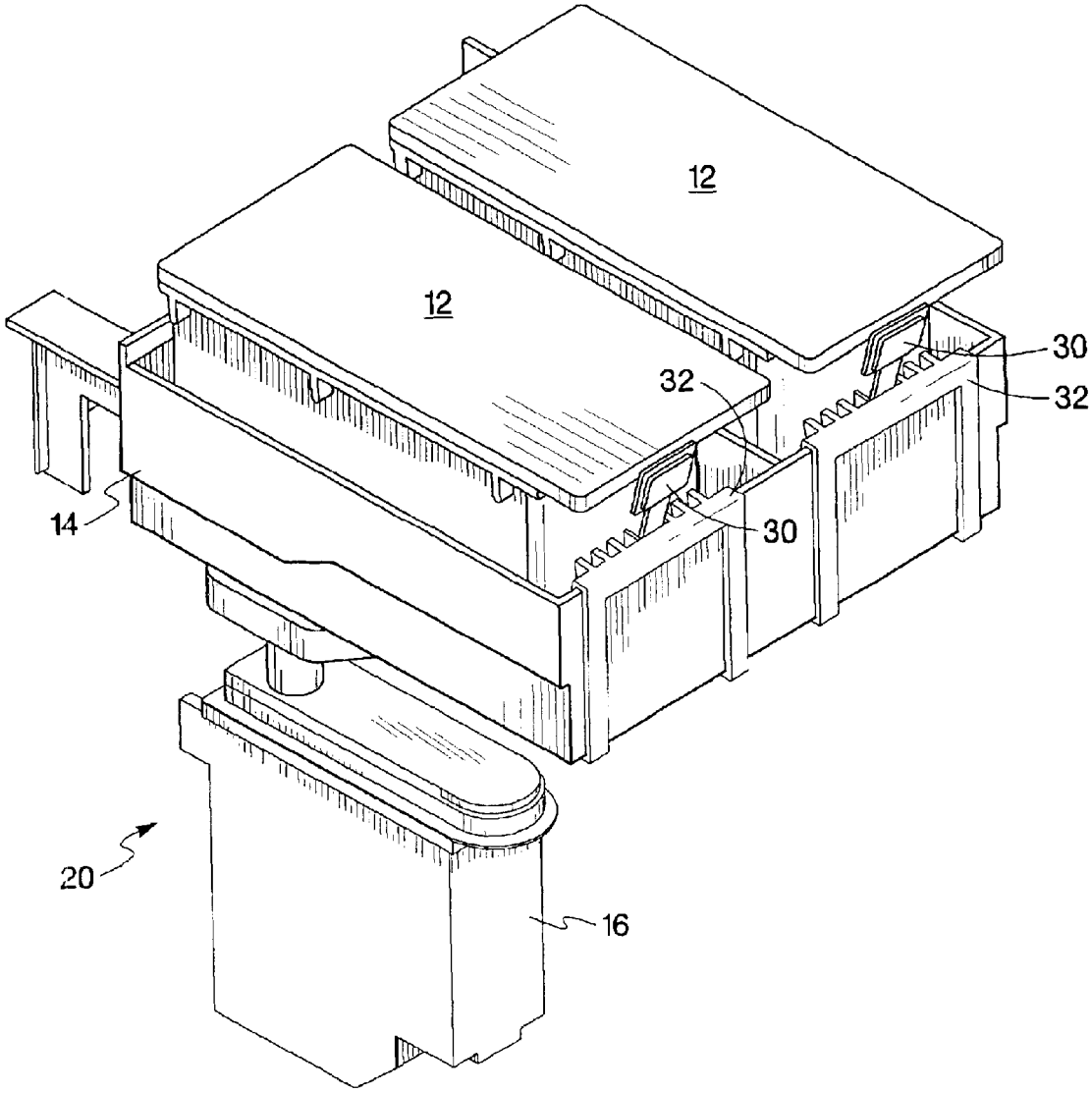
FIG. 2 is a greatly enlarged perspective view of a portion of a scanning carriage showing the replaceable ink containers of the exemplary embodiment positioned in a receiving station that provides fluid communication between the replaceable ink containers and one or more printhead.

FIG. 2 is a perspective view of a portion of the scanning carriage 20 showing a pair of replaceable ink containers 12 properly installed in the receiving station 14. An inkjet printhead 16 is in fluid communication with the receiving station 14. In the exemplary embodiment, the inkjet printing system 10 shown in FIG. 1 includes a tri-color ink container containing three separate ink colors and a second ink container containing a single ink color. In this exemplary embodiment, the tri-color ink container contains cyan, magenta, and yellow inks, and the single color ink container contains black ink for accomplishing four-color printing. The replaceable ink containers 12 can be partitioned differently to contain fewer than three ink colors or more than three ink colors if more are required. For example, in the case of high fidelity printing, frequently six or more colors are used to accomplish printing.

The receiving station 14 shown in FIG. 2 is shown fluidically coupled to a single printhead 16 for simplicity. In the exemplary embodiment, four inkjet printheads 16 are each fluidically coupled to the receiving station 14. In this exemplary embodiment, each of the four printheads are fluidically coupled to each of the four colored inks contained in the replaceable ink containers. Thus, the cyan, magenta, yellow and black printheads 16 are each coupled to their corresponding cyan, magenta, yellow and black ink supplies, respectively.

Other configurations, which make use of fewer printheads than four, are also possible. For example, the printhead 16 can be configured to print more than one ink color by properly partitioning the printhead 16 to allow a first ink color to be provided to a first group of ink nozzles and a second ink color to be provided to a second group of ink nozzles, with the second group of ink nozzles different from the first group. In this manner, a single printhead 16 can be used to print more than one ink color allowing fewer than four printheads 16 to accomplish four-color printing. The fluidic path between each of the replaceable ink containers 12 and the printhead 16 will be discussed in more detail with respect to FIG. 3.

Each of the replaceable ink containers 12 includes a latch 30 for securing the replaceable ink container 12 to the receiving station 14. The receiving station 14 in the exemplary embodiment includes a set of keys 32 that interact with corresponding keying features (not shown) on the replaceable ink container 12. The keying features on the replaceable ink container 12 interact with the keys 32 on the receiving station 14 to ensure that the replaceable ink container 12 is compatible with the receiving station 14.

Figure 3:
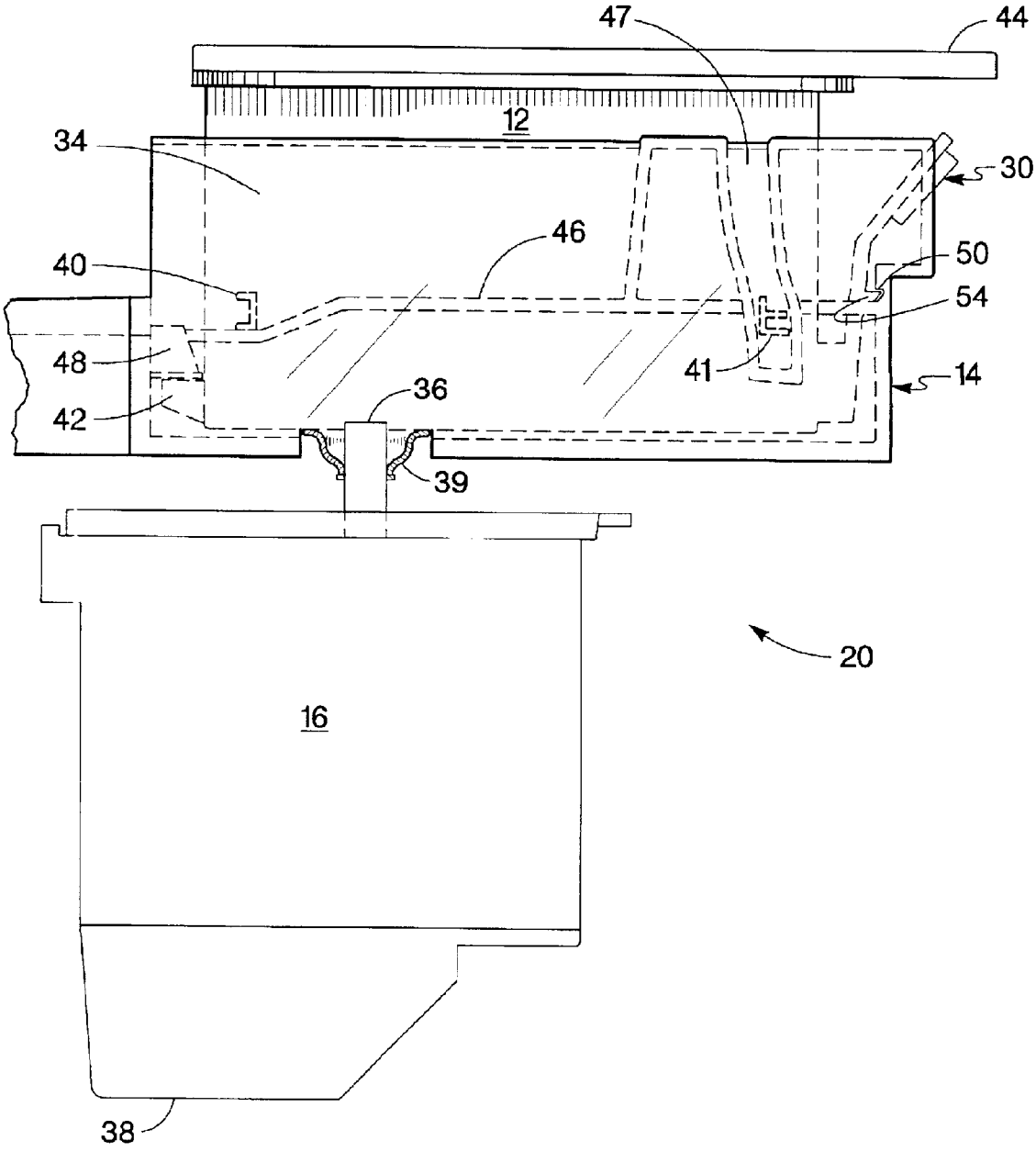
FIG. 3 is a side plan view of a portion of the scanning carriage showing guiding and latching features associated with each of the replaceable ink container and the receiving station for securing the replaceable ink container, thereby allowing fluid communication with the printhead.

FIG. 3 is a side plan view of the scanning carriage portion 20 shown in FIG. 2. The scanning carriage portion 20 includes the ink container 12 shown properly installed into the receiving station 14, thereby establishing fluid communication between the replaceable ink container 12 and the printhead 16.

The replaceable ink container 12 includes a reservoir portion 34 for containing one or more quantities of ink. In the exemplary embodiment, the tri-color replaceable ink container 12 has three separate ink containment reservoirs, each containing ink of a different color. In this exemplary embodiment, the monochrome replaceable ink container 12 is a single ink reservoir 34 for containing ink of a single color.

In the exemplary embodiment, the reservoir 34 has a capillary storage member (not shown) disposed therein. The capillary storage member is a porous member having sufficient capillarity to retain ink to prevent ink leakage from the reservoir 34 during insertion and removal of the ink container 12 from the printing system 10. This capillary force must be sufficiently great to prevent ink leakage from the ink reservoir 34 over a wide variety of environmental conditions such as temperature and pressure changes. In addition, the capillarity of the capillary member is sufficient to retain ink within the ink reservoir 34 for all orientations of the ink reservoir as well as a reasonable amount of shock and vibration the ink container may experience during normal handling. The exemplary capillary storage member is a network of heat bonded polymer fibers described in U.S. patent application entitled "Ink Reservoir for an Inkjet Printer" filed on Oct. 29, 1999, Ser. No. 09/430,400, assigned to the assignee of the present invention and incorporated herein by reference.

Once the ink container 12 is properly installed into the receiving station 14, the ink container 12 is fluidically coupled to the printhead 16 by way of fluid interconnect 36. Upon activation of the printhead 16, ink is ejected from the ejection portion 38 producing a negative gauge pressure, sometimes referred to as backpressure, within the printhead 16. This negative gauge pressure within the printhead 16 is sufficient to overcome the capillary force, retaining within the capillary member disposed within the ink reservoir 34. Ink is drawn by this backpressure from the replaceable ink container 12 to the printhead 16. In this manner, the printhead 16 is replenished with ink provided by the replaceable ink container 12.

The fluid interconnect 36 is preferably an upstanding ink pipe that extends upwardly into the ink container 12 and downwardly to the inkjet printhead 16. The fluid interconnect 36 is shown greatly simplified in FIG. 3. In the exemplary embodiment, the fluid interconnect 36 includes a compliant sealing member 39 that is attached to the fluid interconnect 36. The compliant sealing member 39 engages the ink container 12 to prevent or limit air from entering either the ink container or a fluid delivery system. Air which enters the ink container can make its way into the printhead 16 which can reduce printhead life or print quality.

In the exemplary embodiment, the fluid interconnect 36 extends into the reservoir 34 to compress the capillary member, thereby forming a region of increased capillarity adjacent the fluid interconnect 36. This region of increased capillarity tends to draw ink toward the fluid interconnect 36, thereby allowing ink to flow through the fluid interconnect 36 to the printhead 16. As will be discussed, with the ink container 12 properly positioned within the receiving station 14, the capillary member is compressed by the fluid interconnect 36. Proper compression of the capillary member is necessary to establish a reliable flow of ink from the ink container 12 to the printhead 16.

The replaceable ink container 12 further includes a first guide feature 40, a second guide feature 41, an engagement feature 42, a handle 44 and a latch feature 30. The first guide feature 40 and the second guide feature 41 that allow the ink container 12 to be inserted into the receiving station 14 to achieve reliable fluid interconnection with the printhead 16 as well as form reliable electrical interconnection between the replaceable ink container 12 and the scanning carriage 20 as will be discussed with respect to FIGS. 7*a*–7*c* and 8*a*–8*b*.

The receiving station 14 includes a guide rail 46, a guide slot 47, an engagement feature 48 and a latch engagement feature 50. The guide rail 46 cooperates with the guide feature 40 on the replaceable ink container 12 to guide the ink container 12 into the receiving station 14. Once the replaceable ink container 12 is fully inserted into the receiving station 14, the engagement feature 42 associated with the replaceable ink container engages the engagement feature 48 associated with the receiving station 14, securing a front end or a leading end of the replaceable ink container 12 to the receiving station 14.

The guide feature 41 cooperates with the guide slot 47 to guide the ink container 12 in a pivot motion toward the receiving station 14 to properly engage the fluid outlet 36. In addition, the cooperation of the guide feature 41 and the guide slot 47 ensure that a proper seal is formed between the ink container 12 and the sealing member. With the ink container 12 fully inserted into the receiving station 14 a latch engagement feature 50 associated with the receiving station 14 engages a hook feature 54 associated with the latch member 30 to secure a back end or trailing end of the ink container 12 to the receiving station 14. It is the cooperation of the features on the ink container 12 with the features associated with the receiving station 14 that allow proper insertion and functional interfacing between the replaceable ink container 12 and the receiving station 14. The receiving station 14 will now be discussed in more detail with respect to FIG. 4.

Figure 4:
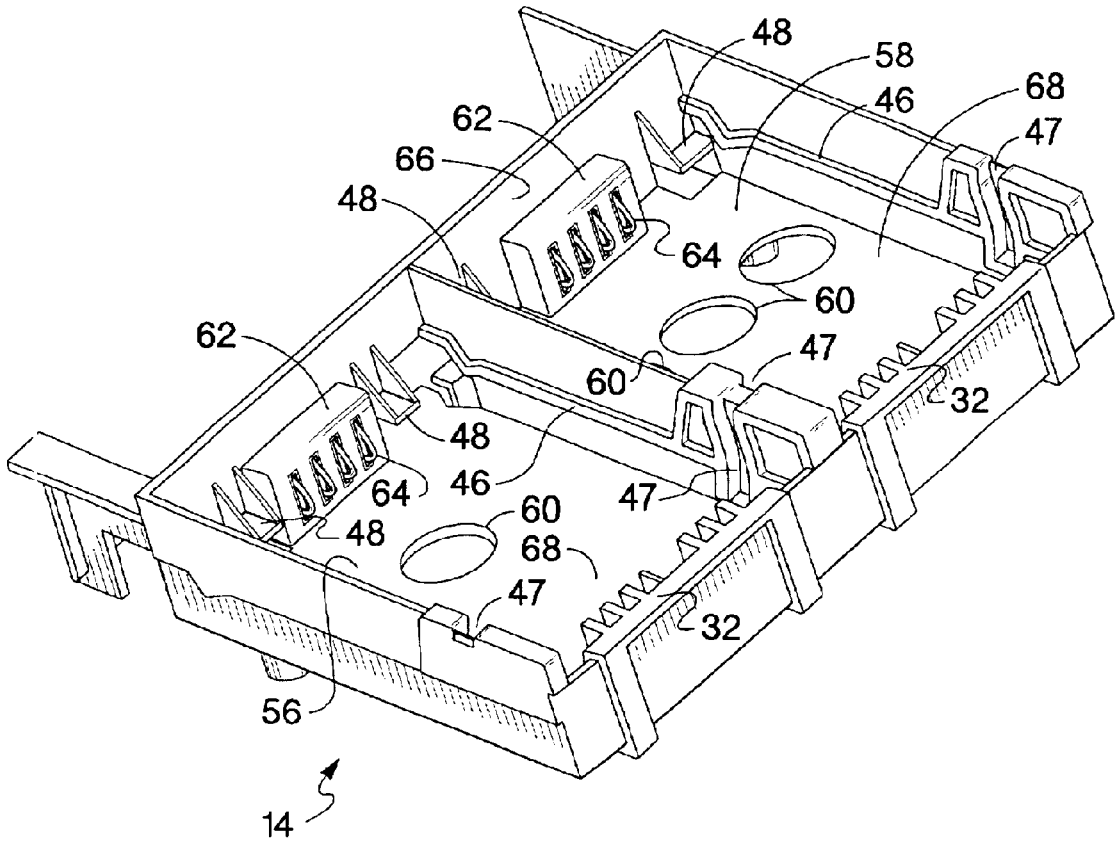
FIG. 4 is a receiving station shown in isolation for receiving one or more replaceable ink containers of the exemplary embodiment.

FIG. 4 is a front perspective view of the ink receiving station 14 shown in isolation. The receiving station 14 shown in FIG. 4 includes a monochrome bay 56 for receiving an ink container 12 containing a single ink color and a tri-color bay 58 for receiving an ink container having three separate ink colors contained therein. In this exemplary embodiment, the monochrome bay 56 receives a replaceable ink container 12 containing black ink, and the tri-color bay receives a replaceable ink container containing cyan, magenta, and yellow inks, each partitioned into a separate reservoir within the ink container 12. The receiving station 14 as well as the replaceable ink container 12 can have other arrangements of bays 56 and 58 for receiving ink containers containing different numbers of distinct inks contained therein. In addition, the number of receiving bays 56 and 58 for the receiving station 14 can be fewer or greater than two. For example, a receiving station 14 can have four separate bays for receiving four separate monochrome ink containers 12 with each ink container containing a separate ink color to accomplish four-color printing.

Each bay 56 and 58 of the receiving station 14 includes an aperture 60 for receiving the upright fluid interconnect 36 that extends therethrough. The fluid interconnect 36 is a fluid inlet for ink to exit a corresponding fluid outlet associated with the ink container 12. An electrical interconnect 62 is also included in each receiving bay 56 and 58. The electrical interconnect 62 includes a plurality of electrical contacts 64. In the exemplary embodiment, the electrical contacts 64 are an arrangement of four spring-loaded electrical contacts with proper installation of the replaceable ink container 12 into the corresponding bay of the receiving station 14. Proper engagement with each of the electrical connectors 62 and fluid interconnects 36 is established in a reliable manner.

The guide rails 46 disposed on either side of the fluid interconnects 60 within each bay 56 and 58 engage the corresponding guide feature 40 on either side of the ink container 12 to guide the ink container into the receiving station. When the ink container 12 is fully inserted into the receiving station 14, the engagement features 48 disposed on a back wall 66 of the receiving station 14 engage the corresponding engagement features 42 shown in FIG. 3 on the ink container 12. The engagement features 48 in the exemplary embodiment are disposed on either side of the electrical interconnect 62.

The guide slot 47 in the exemplary embodiment is a pair of guide slots 47 disposed on either side of the fluid interconnects 60 within each bay 56 and 58. The guide slots 47 cooperate with guide feature 41 to guide the ink container 12 into the receiving station 14. Upon proper insertion of the ink container 12 into the receiving station 14 fluidic and electrical interconnections are established between the ink container 12 and the receiving station 14.

FIGS. 5*a*, 5*b*, 5*c*, and 5*d* show front plan, side plan, back plan, and bottom plan views, respectively, of the replaceable ink container 12 of the exemplary embodiment. As shown in FIG. 5*a* and FIG. 5*b*, the replaceable ink container 12 includes a pair of outwardly projecting guide features 40 and a pair of outwardly projecting guide features 41.

In the exemplary embodiment, each of these guide features 40, 41 extend outwardly in a direction orthogonal to upright side 70 of the replaceable ink container 12. The pair of guide features 40 is disposed forward, toward a front surface or leading edge 72, of a central axis 71 of a minor axis of the ink container 12. The pair of guide features 41 is disposed behind the central axis 71 of a minor axis of the ink container 12. In addition, in this exemplary embodiment, each of the pairs of guide features 40 and 41 are disposed on opposite sides of a central axis 73 of a major axis of the ink container 12. In this exemplary embodiment, the guide features 40, 41 are disposed below each of the central axes 71 and 73.

In contrast to the guide features that extend from the sides 70 of the ink container 12, the engagement features 42 extend outwardly from the front surface or leading edge 72 of the ink container 12. The engagement features 42 are disposed on either side of an electrical interface 74 and are disposed toward a bottom surface 76 of the replaceable ink container 12. The electrical interface 74 includes a plurality of electrical contacts 78, with each of the electrical contacts 78 electrically connected to an electrical storage device 80.

Opposite the leading end 72 is a trailing end 82 shown in FIG. 5*c*. The trailing end 82 of the replaceable ink container 12 includes the latch feature 30 having an engagement hook 54. The latch feature 30 is formed of a resilient material that allows the latch feature to extend outwardly from the trailing end thereby extending the engagement feature outwardly toward the corresponding engagement feature associated with the receiving station 14. As will be discussed as the latch member 30 is compressed inwardly toward the trailing end 82, the latch member exerts a biasing force outwardly in order to ensure the engagement feature 54 remains in engagement with the corresponding engagement feature 50 associated with the receiving station 14 to secure the ink container 12 into the receiving station 14.

The replaceable ink container 12 also includes keys 84 disposed on the trailing end of the replaceable ink container 12. The keys are preferably disposed on either side of the latch 30 toward the bottom surface 76 of the replaceable ink container 12. The keys 84, together with keying features 32 on the receiving station 14, interact to ensure the ink container 12 is inserted in the correct bay 56 and 58 in the receiving station 14. In addition, the keys 84 and the keying features 32 ensure that the replaceable ink container 12 contains ink that is compatible both in color and in chemistry or comparability with the corresponding receiving bay 56 and 58 within the receiving station 14.

Also included in the ink container 12 is the handle portion 44 disposed on a top surface 86 at the trailing edge 82 of the replaceable ink container 12. The handle 44 allows the ink container 12 to be grasped at the trailing edge 82 while inserted into the appropriate bay of the receiving station 14.

Finally, the ink container 12 includes apertures 88 disposed on the bottom surface 76 of the replaceable ink container 12. The apertures 88 allow the fluid interconnect 36 to extend through the reservoir 34 to engage the capillary member disposed therein. In the case of the tri-color replaceable ink container 12, there are three fluid outlets 88, with each fluid outlet corresponding to a different ink color. In the case of the tri-color chamber, each of three fluid interconnects 36 extend into each of the fluid outlets 88 to provide fluid communication between each ink chamber and the corresponding print head for that ink color.

Figure 6:
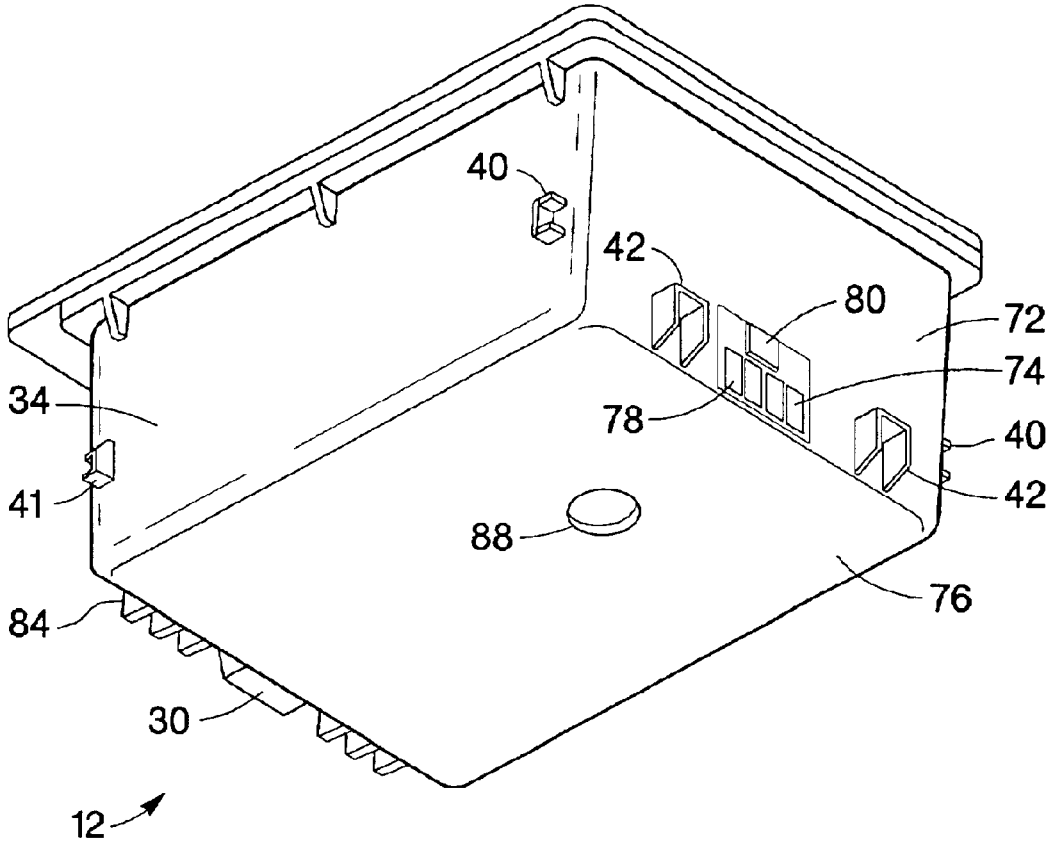
FIG. 6 is a perspective view of a single color replaceable ink container of the exemplary embodiment.

FIG. 6 is a perspective view of a monochrome ink container positioned for insertion into the monochrome bay 56 in the receiving station 14 shown in FIG. 4. The monochrome ink container shown in FIG. 6 is similar to the tri-color ink container shown in FIGS. 5*a* through 5*d* except that only a single fluid outlet 88 is provided in the bottom surface 76. The monochrome replaceable ink container 12 contains a single ink color and therefore receives only a single corresponding fluid interconnect 36 for providing ink from the ink container 12 to the corresponding printhead.

Figure 7A:
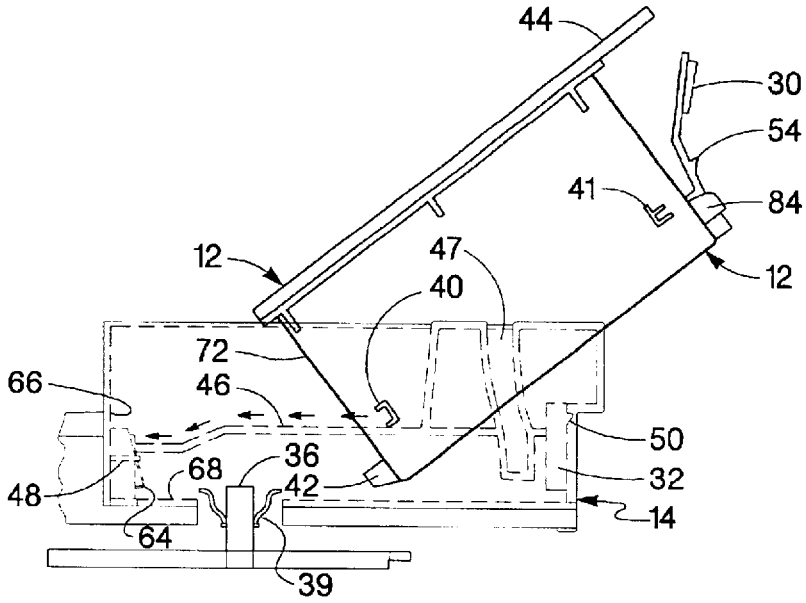
FIGS. 7*a*, 7*b*, and 7*c* depict an exemplary method for inserting the exemplary replaceable ink container into the supply station.
Figure 7B:
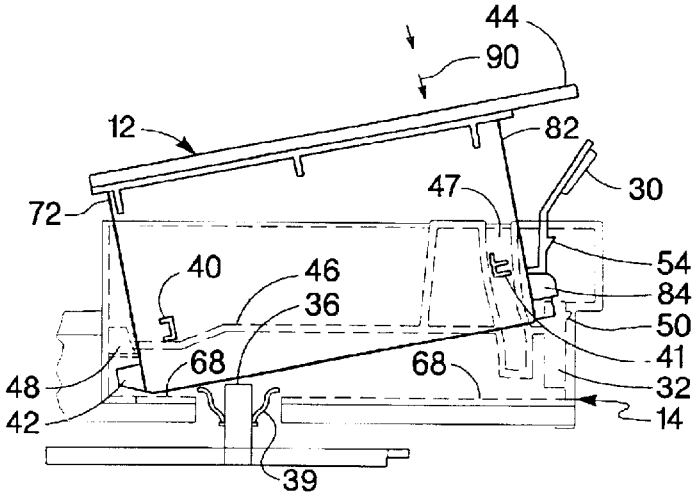
Figure 7C:
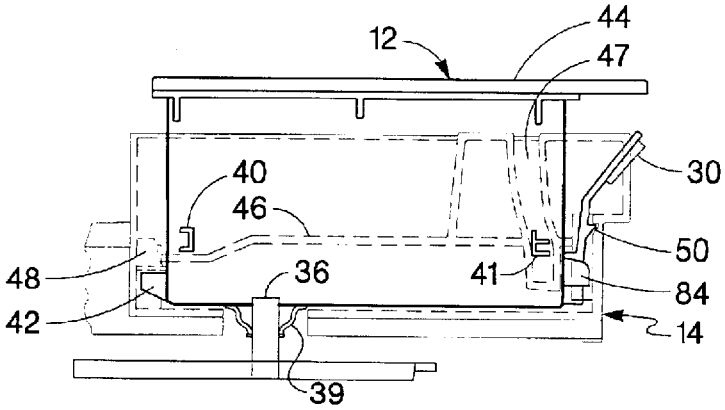

FIG. 7*a*, 7*b*, and 7*c* is a sequence of figures to illustrate the technique of the present disclosure for inserting the replaceable ink container 12 into the receiving station 14 to form reliable fluidic connections with the receiving station 14.

FIG. 7*a* shows the ink container 12 partially inserted into the receiving station 14. In the exemplary embodiment, the ink container 12 is inserted into the receiving station 14 by grasping the handle portion 44 and inserting the ink container into the receiving station with the leading edge or leading face 72 first. As the leading edge 72 enters the receiving station 14 the outwardly extending guide features 40 on the ink container engage each of the pair of guide rails 46. The guide rails 46 guide the ink container 12 in a horizontal or linear motion toward the back wall 66 of the receiving station 14. The guide rails 46 then guide the replaceable ink container in both a horizontal direction toward the back wall 66 and a vertical direction toward the bottom surface of the receiving station 14 such that the engagement feature 42 on the ink container 12 is received by a corresponding engagement feature 48 on the back wall 66 of the receiving station 14 as shown in FIG. 7*b*. The insertion of the ink container 12 requires only an insertion force to urge the ink container linearly along the guide rail 46. The gravitational force acting on the ink container 12 tends to cause the ink container to follow the guide rails 46 as the guide rails extend in a downward direction to allow engagement of engagement features 42 and 48. The guide features 40 are preferably shaped to facilitate proper positioning the engagement feature 42 on the ink container 12 below the corresponding engagement feature 48 on the back wall 66 of the receiving station 14 as the ink container 12 is slid along the guide rails 46.

FIG. 7*b* shows the ink container 12 inserted into the receiving station 14 such that the engagement feature 42 is in engagement with the engagement feature 48 associated with the receiving station 14. A downward force is applied to the ink container 12 as represented by arrows 90 to urge the trailing end 82 of the ink container 12 downwardly toward the bottom surface 68 of the receiving station 14. The ink container 12 is guided downward by the guide feature 41 that follows the guide slot 47. The ink container 12 as it is guided downward pivots about a pivot axis defined by the engagement features 42, 48. As the ink container 12 pivots about this pivot axis the ink container 12 is guided by the interaction of the guide feature 41 and the guide slot 47 to ensure a proper seal is formed between the ink container 12 and the sealing member 39.

Movement of the ink container 12 is controlled by the interaction of the guide feature 41 and the guide slot 47 to ensure the sealing member 39 is engaged with a downward motion. This downward motion tends to create a uniform vertical displacement of the sealing member 39 during engagement with the ink container 12. This uniform displacement tends to produce a uniform sealing force the compliant sealing member 39 exerts against the ink container 12 to form a good air seal. Therefore, the guide feature 41 and the guide slot 47 tend to prevent non-uniform displacement of the compliant sealing member 39. This non-uniform displacement tends to result in side loading of the sealing member that can produce an ineffective seal between the sealing member and the ink container 12.

The keys 84 on the ink container 12 and the keying features 32 on the receiving station 14 allow for the complete insertion of the proper ink container 12 into the proper receiving station 14. The downward force applied to the trailing end 82 of the ink container 12 causes the ink container 12 to pivot about a pivot axis thereby moving the trailing edge 82 of the ink container 12 toward the bottom surface 68 of the receiving station 14. As the ink container 12 is urged downward into the receiving station 14, the resilient latch 30 is compressed slightly inward toward the trailing edge 82 of the ink container 12. Once the ink container 12 is urged downward sufficiently far, the engagement feature 54 on the latch 30 engages with a corresponding engagement feature 50 on the receiving station 14 to secure the ink container 12 to the receiving station 14 as shown in FIG. 7*c*.

With the ink container 12 properly secured in the receiving station 14 as shown in FIG. 7*c* the fluid interconnect 36 extends into the reservoir 34 to compress the capillary member, thereby forming a region of increased capillarity adjacent the fluid interconnect 36. This region of increased capillarity tends to draw ink toward the fluid interconnect 36, thereby allowing ink to flow through the fluid interconnect 36 to the printhead 16. In the exemplary embodiment, the ink container 12 when inserted into the receiving station 14 is oriented in a gravitational frame of reference so that a gravitational force acts on ink within the ink container 12 tending to draw ink toward the bottom surface 76 of the ink container 12. Thus ink within the ink container 12 is drawn to the bottom surface 76 where this ink is drawn toward the fluid interconnect 36 by capillary attraction thereby tending to reduce or minimize stranding of ink within the ink container 12.

Figure 8B:
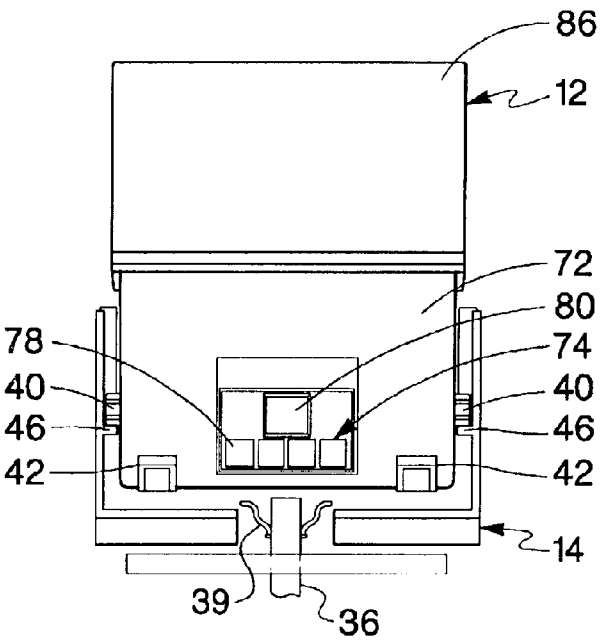
FIGS. 8*a* and 8*b* depict the passage of the replaceable ink container over an upstanding fluid inlet on the receiving station viewed from a side view and an end view, respectively.
Figure 8A:
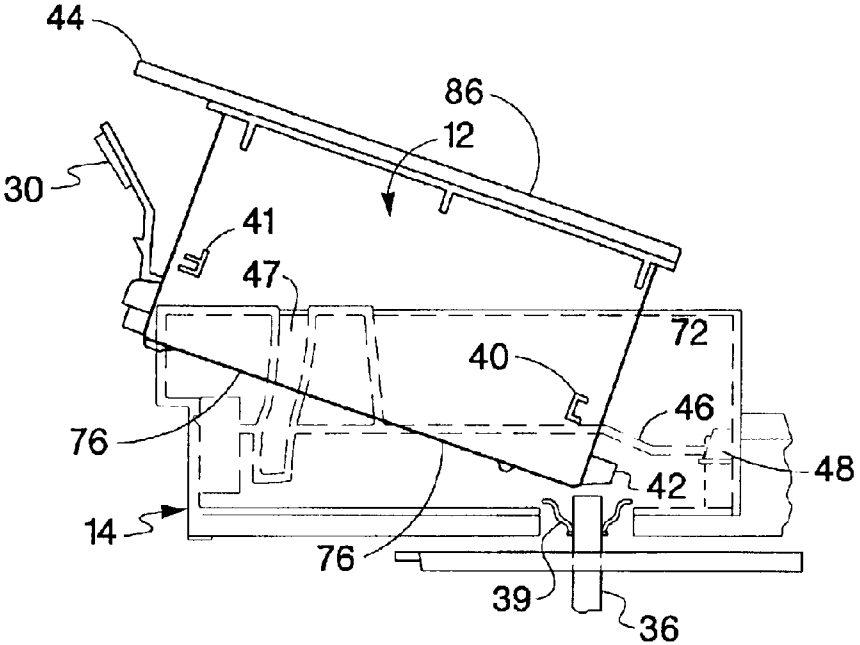

FIGS. 8*a* and 8*b* illustrate a position in the insertion process described with respect to FIGS. 7*a*, 7*b* and 7*c* wherein the leading edge 72 of the ink container 12 is positioned over the fluid interconnect 36. FIG. 8*a* depicts a side view with FIG. 8*b* showing an end view. It can be seen from FIGS. 8*a* and 8*b* that the guide feature 40 must be positioned on the ink container 12 low enough toward the bottom surface 76 of the ink container 12 such that the leading edge 72 of the ink container does not collide the fluid interconnect 36 during insertion. Another constraint on the positioning of the guide member 40 is that the guide member 40 must be positioned sufficiently close to the top surface 86 of the ink container 12 to insure that the engagement feature 42 properly engages with the corresponding engagement feature 48 on the receiving station 14.

In addition, the outwardly extending guide members 40 on the ink container must extend outward sufficiently far to engage the guide rails 46. However, the outwardly extending guide members 40 should not extend too far outward such that the guide members 40 engage the upright sides in the receiving station 14, producing interference which produces friction and binding which resists insertion of the ink container 12 into the receiving station 14.

Figure 9A:
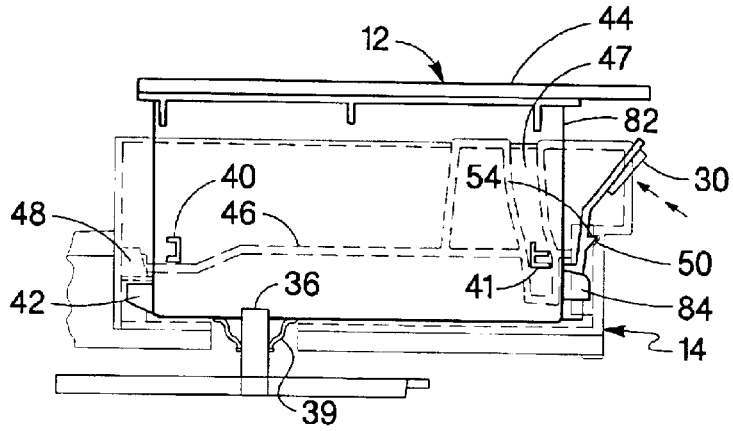
FIGS. 9*a*, 9*b*, and 9*c* depict a method for removing the exemplary replaceable ink container from the receiving station.
Figure 9B:
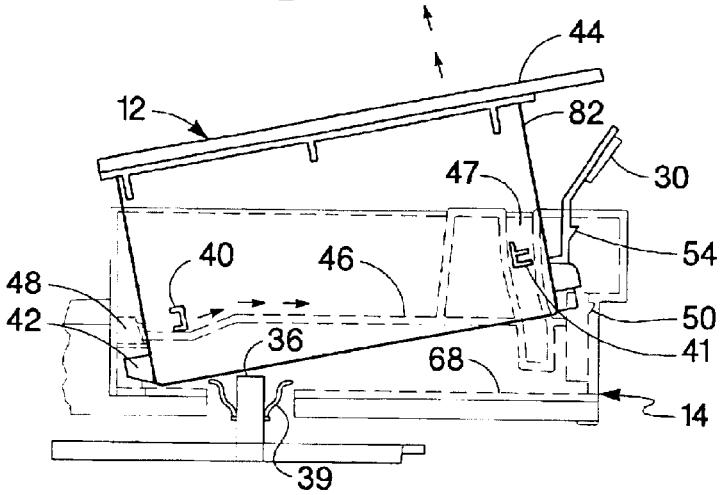
Figure 9C:
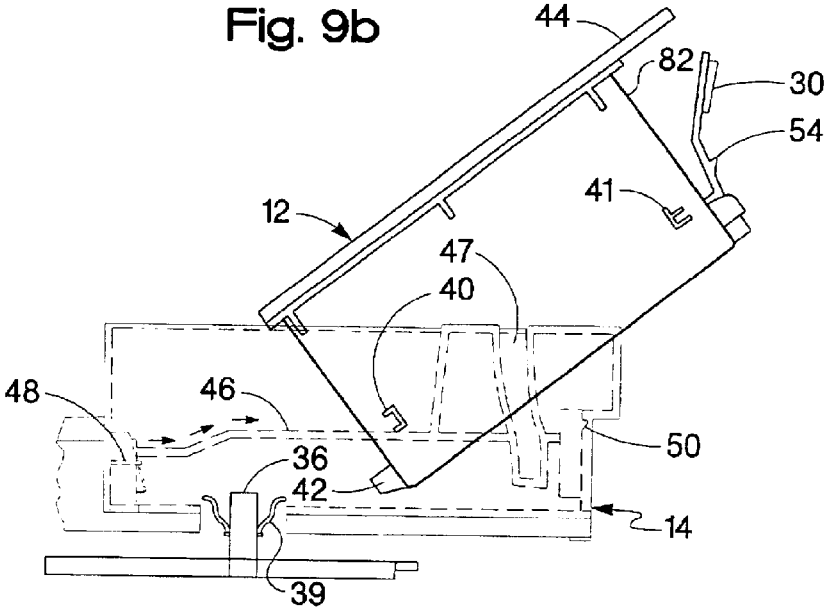

FIGS. 9*a*, 9*b*, and 9*c* illustrate the technique for removing the ink container 12 from the receiving station 14. The technique for removing the ink container 12 of the present invention begins with the release of the engagement feature from the corresponding engagement feature 50 on the receiving station 14 by urging the latch 30 toward the trailing surface 82. Once the trailing edge of the ink container 12 is released the trailing edge of the ink container 12 is moved upward as shown in FIG. 9*b*. The ink container 12 can be grasped by handle 44 to retrieve the ink container 12 in a direction opposite the insertion direction. As the ink container 12 is withdrawn from the receiving station 14, the guide member 40 follows the guide rails 46 to lift the ink container, thereby preventing interference between the fluid interconnect 36 and the fluid outlet on the bottom surface of the ink container 12.

The ink container 12 of the present invention is configured to engage and interact with the receiving station 14 to guide the ink container 12 into the receiving station and for a reliable fluid connection with the receiving station 14. The technique of the present invention allows this insertion process to be relatively simple and easy to prevent improper insertion of the ink container 12. The customer grasps the ink container 12 by the handle portion 44 and slides the ink container 12 horizontally into the receiving station 14. The guide rails 46 and guide features 40 cooperate to properly guide the ink container 12 into the receiving station 14. The guide slot 47 and guide features 41 cooperate to ensure that a proper fluidic interconnection is formed between the ink container 12 and the receiving station 14. The ink container 12 is pressed downwardly to latch and secure the ink container 12 in place within the receiving station 14.

What is claimed is:

1. An ink container to be received within a receiving station of an inkjet printing system, the receiving station having a fluid inlet having a compliant seal and a pair of guide slots extending along either side of the fluid inlet, the ink container comprising:

a first guide feature outwardly extending therefrom, the first guide feature disposed toward a trailing end relative to an insertion direction; and wherein the first guide feature is configured to cooperate with the at least one guide slot to guide the ink container in a pivot motion to ensure the ink container engages the compliant seal forming a seal therewith.

2. The ink container of claim 1 wherein the guide feature is a pair of guide features that each extend outwardly from an ink container housing.

3. The ink container of claim 2 wherein the ink container housing defines a fluid outlet in a bottom portion thereof relative to a gravitational frame of reference.

4. The ink container of claim 2 wherein the ink container housing defines a leading end and a trailing end relative to an insertion direction and a pair of sidewalls each extending between the leading and trailing ends and wherein the pair of guide features each extend outwardly from each of the pair of sidewalls.

5. The ink container of claim 1 further including a second guide feature outwardly extending therefrom, the second guide feature disposed toward a leading end relative to an insertion direction into the printing system.

6. The ink container of claim 5 wherein the ink container leading end and trailing end are disposed along a major axis of the ink container and a pair of sidewalls are disposed along a minor axis of the ink container, and wherein the second guide feature is a pair of guide features extending outwardly from the sidewalls along the minor axis.

7. The ink container of claim 1 wherein the receiving station includes a guide slot and wherein the guide feature is configured to engage the guide slot to guide the ink container in a pivot motion so that the ink container engages a compliant seal on the inkjet printing system.

8. An ink container for insertion into an inkjet printing system, the ink container comprising:

an ink container housing defining a leading end and a trailing end relative to an insertion direction and a pair of sidewalls each extending between the leading and trailing ends;

a first pair of guide features, each of the first pair extending outwardly from each of the pair of sidewalls; and a second pair of guide features, each of the second pair extending outwardly from each of the pair of sidewalls.

9. The ink container of claim 8 wherein the leading end and a trailing end are disposed on a central axis along a major axis of the ink container and the pair of sidewalls are disposed on a central axis along a minor axis of the ink container and wherein the first pair of guide features are disposed toward the leading end of the central axis along the minor axis and the second pair of guide features are disposed toward the trailing end of the central axis along the minor axis.

10. The ink container of claim 8 wherein the ink container housing defines a fluid outlet in a bottom portion thereof relative to a gravitational frame of reference.

11. The ink container of claim 8 further including an engagement feature disposed on the leading edge, the engagement feature configured to engage corresponding engagement features associated with the receiving station.

12. The ink container of claim 11 wherein the inkjet printing system includes at least one guide slot and wherein the second pair of guide features is configured to engage the at least one guide slot to guide the ink container in a pivot motion so that the ink container engages a compliant seal on the inkjet printing system.

13. The ink container of claim 11 wherein the inkjet printing system includes a guide rail and wherein the first pair of guide features is configured to engage the guide rail to guide the ink container into the inkjet printing system.

14. The ink container of claim 11 wherein the inkjet printing system includes an engagement feature configured to engage corresponding engagement features associated with the ink container.

15. A replaceable ink container to be received within a receiving station of an inkjet printing system for providing ink to the inkjet printing system, the receiving station having a fluid inlet having a compliant seal and a pair of guide slots extending along either side of the fluid inlet, an engagement feature disposed on a leading edge of the replaceable ink container, the engagement feature configured to engage corresponding engagement features associated with the receiving station, the replaceable ink container comprising:

a fluid outlet configured for connection to the fluid inlet associated with the receiving station; and a guide slot engagement feature disposed toward a trailing end of the replaceable ink container relative to an insertion direction, wherein with the engagement feature disposed on the leading edge of the replaceable ink container engaged with the corresponding engagement features associated with the receiving station, the guide slot engagement feature is so disposed and arranged on the replaceable ink container to interact with at least one of the pair of guide slots to guide the replaceable ink container into the receiving station to align the fluid outlet with the fluid inlet and to engage the compliant seal to establish a seal between the replaceable ink container and compliant seal.

16. The replaceable ink container of claim 15 wherein the inkjet printing system includes a guide rail and wherein the replaceable ink container further includes a pair of guide rail engagement features that are configured to engage the guide rail to guide the ink container into the inkjet printing system.

17. A method for inserting a replaceable ink container into a receiving station of an inkjet printing system, the receiving station disposed on a scanning carriage and fluidically coupled to an ink ejection portion mounted thereon, the method for inserting the ink container comprising:

engaging an engagement feature on a leading edge of the replaceable ink container with a corresponding engagement features associated with the receiving station;

engaging a pair of outwardly extending guide features disposed toward a trailing end of the ink container; and urging the ink container toward the receiving station wherein each of the pair of guide features guide the replaceable ink container along an arc about a pivot axis toward a bottom surface of the receiving station to align a fluid outlet on the replaceable ink container with a compliant sealing structure about a fluid inlet to form a seal with the fluid outlet.

18. The method of claim 17 wherein prior to engaging an engagement feature on a leading edge, the method including:

engaging a pair of outwardly extending guide rail engagement features on the toward the leading edge of the ink container with each of a pair of guide rails on the receiving station; and urging the ink container toward the receiving station wherein each of the pair of guide rails guide the replaceable ink container linearly toward a back wall of the receiving station to align the engagement feature with the corresponding engagement features.

* * * * *